United States Patent [19]

Zysset

[11] 4,406,378

[45] Sep. 27, 1983

[54] METALLIC CONVENIENCE CLOSURE

[75] Inventor: Edgar H. Zysset, Sylvania, Ohio

[73] Assignee: Automated Container Corporation, Orlando, Fla.

[21] Appl. No.: 280,577

[22] Filed: Jul. 6, 1981

[51] Int. Cl.[3] ..... B65D 17/34; B65D 17/46

[52] U.S. Cl. ..... 220/273

[58] Field of Search ..... 220/265–273

[56] References Cited

U.S. PATENT DOCUMENTS 3,630,408 12/1971 Elser ..... 220/273

4,108,331 8/1978 Khoury ..... 220/269

*Primary Examiner*—George T. Hall

*Attorney, Agent, or Firm*—Duckworth, Allen, Dyer & Pettis

[57] ABSTRACT

A metallic convenience closure for a cylindrical container comprises a panel, an endless score line formed in the panel and defining a central removable portion and a peripheral fixed portion, means forming a part of the fixed portion for attaching a closure to the end of a container to close the end, a manually graspable pull-tab attached to the removable portion of the panel and having a nose portion movable upon lifting of the tab into position adjacent the score line for severing the score line, and stiffening means on the removable panel extending generally parallel to the direction of pull of the pull-tab such that said stiffening means will resist the tendency of the removable portion to bend transversely of the general pull direction.

6 Claims, 5 Drawing Figures

METALLIC CONVENIENCE CLOSURE

This invention relates to metallic convenience closures for cylindrical containers.

BACKGROUND AND SUMMARY OF THE INVENTION

A common type of metallic convenience closure comprises a panel with an endless score line forming a central removable portion and a peripheral fixed portion that is attached to the cylindrical container. A pull-tab having a nose portion is provided so that when the pull-tab is manually grasped, the nose portion of the pull-tab moves into position adjacent the score line severing the panel. Further movement of the pull-tab completes the severing to remove the removable portion. Typical patents showing such construction are U. S. Pat. Nos. 3,696,961, 3,705,563, 3,819,083 and 3,986,632.

One of the problems encountered with such convenience closures is the tendency for the removable portion of the panel to bend transversely of the direction of pull by the pull-tab, that is, diametrically perpendicular to the opening direction. If the bend is severe enough, the removable portion will lock against the scored opening making it difficult, if not impossible, to open.

Accordingly, among the objectives of the present invention are to provide a convenience closure which prevents the bending of the removable portion of the panel during the opening process.

In accordance with the invention, stiffening members in the form of beads are provided generally parallel to the opening direction of the pull-tab. The beads resist bending in the direction of the pull. The beads also permit upward bending or bowing in a direction transverse to direction of the pull so that the removable portion can be more readily removed.

DESCRIPTION

Figure 1:
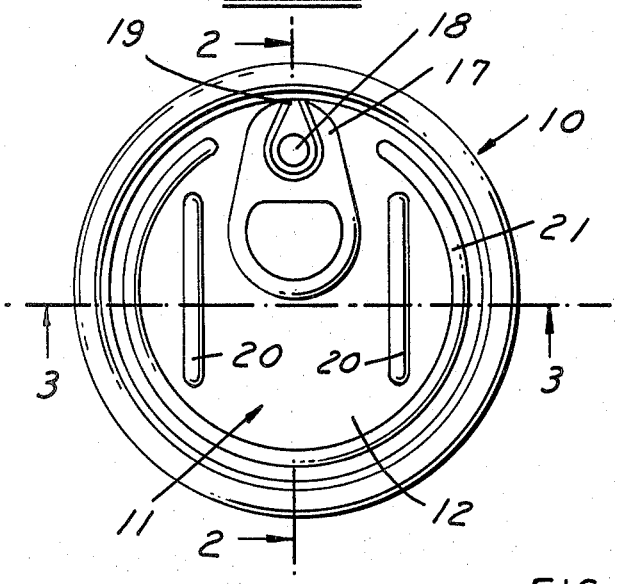
FIG. 1 is a plan view of a convenience container including a closure embodying the invention.
Figure 2:
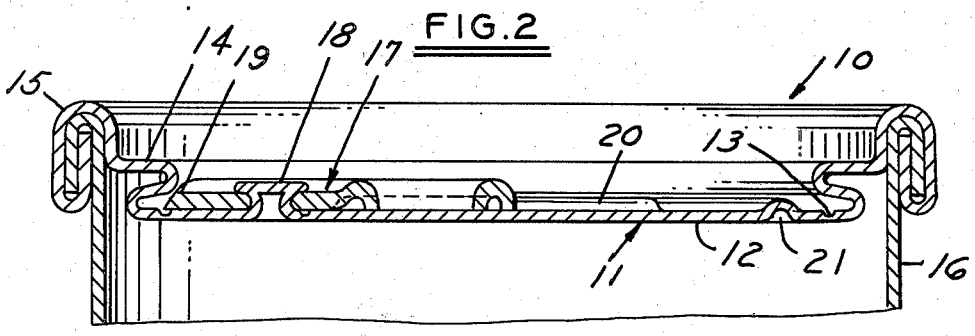
FIG. 2 is a fragmentary sectional view taken along the line 2—2 in FIG. 1.
Figure 3:
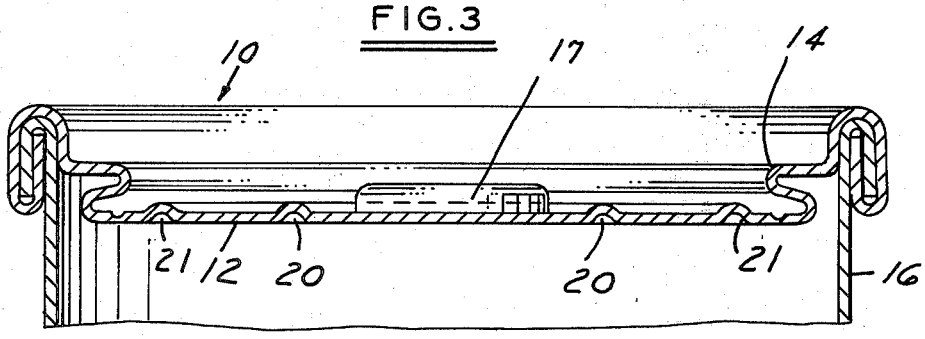
FIG. 3 is a fragmentary sectional view taken along the line 3—3 in FIG. 1.

Referring to FIGS. 1-3, the convenience container includes a metallic closure 10 embodying the invention comprises a metallic panel 11 with a central removable portion 12 defined by an endless score line 13, a peripheral fixed portion comprising an integral safety bead 14 overlying the score line 13, and an annular channel portion 15 whereby the closure can be double seamed to the top of a cylindrical container 16 to close the end of the container 16. In accordance with conventional construction, the convenience closure includes a pull-tab 17 extending generally radially and fastened to the removable panel portion by a rivet 18. The pull-tab 17 includes a nose portion 19 that is movable adjacent the score line 13 when the pull-tab 17 is lifted by hand causing the severing of the panel at the score line 13. Further pulling of the tab 17 in the direction of the arrow completes the severing and removal of the panel.

In accordance with the invention, stiffening means in the form of parallel straight integral beads 20 formed upwardly from the plane of the removable panel are provided and extend generally parallel to the opening direction, that is, parallel to the longitudinal axis of the pull-tab 17 on the removable portion 12 of the panel 11. The stiffening beads 20 extend from adjacent one edge of the removable portion to the other edge adjacent the score line 13 preferably as close as possible to the score line 13 without deforming or rupturing the score line in the manufacturing process.

The removable portion also includes an arcuate bead 21 extending throughout substantially the entire periphery thereof.

Figure 4:
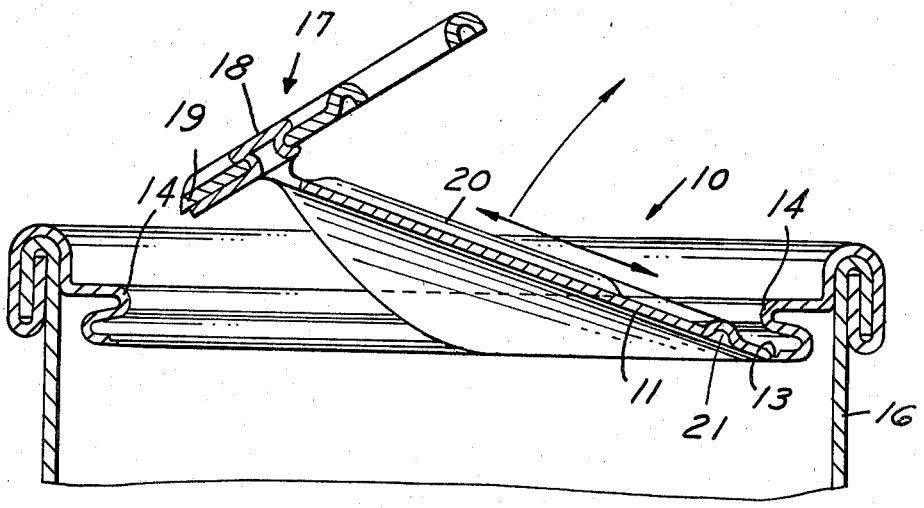
FIG. 4 is a view similar to FIG. 2 showing the opening of the container.
Figure 5:
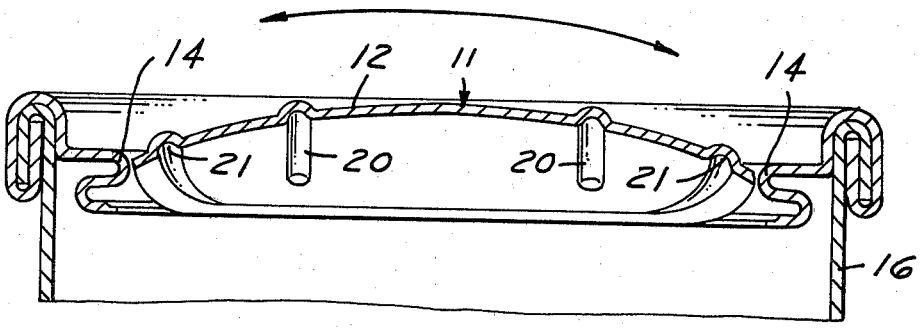
FIG. 5 is a sectional view similar to FIG. 3 showing the opening of the container.

As shown in FIG. 4 when the pull-tab 17 is lifted to puncture and sever the score line 13, the removable portion 12 of the panel is lifted. The stiffening or reinforcement beads 20 stiffen the removable portion 11 in the direction of the double headed arrow shown in FIG. 4 to counteract the tendency for the panel to bend in the direction of the pull. At the same time, the beads tend to facilitate upward bending or bowing of the removable portion 11 of the panel in a direction transverse to the direction of the pull as shown by the double headed arrow in FIG. 5 so that the removable portion can be more readily removed without interference from the safety bead 14.

Thus, the invention makes possible the use of thin metal such as aluminum without undesired bending of the removable portion of the closure during the opening process.

I claim:

1. A metallic convenience closure for a cylindrical container comprising a panel, an endless severing line formed in the central panel and defining a central removable portion and a peripheral fixed portion, means forming a part of the fixed portion for attaching a closure to the end of a container to close said end, a manually graspable pull-tab attached to the removable portion upon lifting of the tab into position adjacent the score line for severing the score line, and stiffening means on the removable portion extending generally parallel to the direction of pull of the pull-tab substantially from one edge of the removable portion to the other adjacent the score line such that said stiffening means will resist the tendency of the removable portion to bend transversely of the pull direction.

2. The metallic convenience closure set forth in claim 1 wherein said stiffening means comprises an integral bead.

3. The metallic convenience closure set forth in claim 1 wherein said stiffening means comprises a pair of beads integral with the removable portion and extending generally parallel to the pull-tab.

4. The metallic convenience closure set forth in claim 1, said fixed portion of said panel including a safety bead, said stiffening means promoting a transverse bend transversely of the pull direction to facilitate movement of the removable portion past the safety bead.

5. A metallic convenience closure for a cylindrical container comprising a panel, an endless severing line formed in the central panel and defining a central removable portion and a peripheral fixed portion, means forming a part of the fixed portion for attaching a closure to the end of a container to close said end, a manually graspable pull-tab attached to the removable portion of the panel and having a nose portion movable upon lifting of the tab into position adjacent the score line for severing the score line, and stiffening beads on the removable panel, each said bead extending externally from the plane of said removable portion and extending generally parallel to the direction of pull of the pull-tab such that said stiffening beads will resist the tendency of the removable portion to bend transversely of the pull direction, each said bead extending substantially from one edge of the removable portion to the other adjacent the score line as close as possible to said score line without deforming or rupturing said score line in the manufacturing process.

6. The metallic convenience closure set forth in claim 5, said fixed portion of said panel including a safety bead, said stiffening beads promoting a transverse bend transversely of the pull direction to facilitate movement of the removable portion past the safety bead.

* * * * *